US006470513B1

(12) United States Patent
Cook

(10) Patent No.: US 6,470,513 B1
(45) Date of Patent: Oct. 29, 2002

(54) EASY RISE HYGIENIC TOILET LIFT

(76) Inventor: Estle A. Cook, Rt. 1, Box 198, Butler, MO (US) 64730

( * ) Notice: Subject to any disclaimer, the term of this patent is extended or adjusted under 35 U.S.C. 154(b) by 0 days.

(21) Appl. No.: 09/697,458

(22) Filed: Oct. 26, 2000

Related U.S. Application Data

(63) Continuation-in-part of application No. 09/323,611, filed on Jun. 1, 1999, now abandoned.
(60) Provisional application No. 60/087,511, filed on Jun. 1, 1998.

(51) Int. Cl.[7] ..... A47K 13/10
(52) U.S. Cl. ..... 4/667; 4/420.4
(58) Field of Search ..... 4/667, 420.4, 420.5, 4/447

(56) References Cited

U.S. PATENT DOCUMENTS 4,321,715 A 3/1982 Baus
4,327,451 A 5/1982 Baus
4,587,678 A 5/1986 Love et al.
4,628,548 A * 12/1986 Kurosawa et al. ..... 4/420.5 X
5,241,712 A * 9/1993 Mahoney ..... 4/420.4 X
5,309,583 A 5/1994 White et al.
5,603,130 A 2/1997 Snijders et al.

* cited by examiner

*Primary Examiner*—Charles E. Phillips
(74) *Attorney, Agent, or Firm*—Hovey Williams LLP

(57) ABSTRACT

A lift is provided for placement over a conventional toilet. The lift includes a raising and lower mechanism which assists users in sitting and standing, a washing mechanism which is used to wash the lower extremities after toilet use, and a drying mechanism which is used to dry the lower extremities after use of the washing mechanism. The lift can be placed inside a housing which is useful for concealing the lift. Advantageously, the washing mechanism is adapted to be stored in a position which is unlikely to be soiled by waste entering the toilet basin and shiftable to a position wherein the lower body parts of a toilet user can be washed. Additionally, the shiftability of the washing mechanism provides a more thorough wash due to its ability to direct a water stream in any direction.

18 Claims, 6 Drawing Sheets

EASY RISE HYGIENIC TOILET LIFT

RELATED APPLICATIONS

This application is a continuation-in-part of application Ser. No. 09/323,611, filed on Jun. 1, 1999, now abandoned, the contents of which are incorporated by reference herein, and claims the benefit of provisional application No. 60/087,511 filed on Jun. 1, 1998.

BACKGROUND OF THE INVENTION

1. Field of the Invention

The present invention is concerned with convenience devices for people who have physical conditions which make using conventional toilet facilities difficult. More particularly, the present invention is concerned with apparatuses which assist a patient in standing after using a toilet. Still more particularly, the present invention is concerned with apparatuses which wash the lower parts of the body after use of a toilet. Finally, and most particularly, the present invention is concerned with apparatuses which wash and dry the lower parts of the body after toilet use and thereafter raise the user to a partially standing position.

2. Description of the Prior Art

Many devices have been developed to aid the infirm, elderly, or physically handicapped in using restroom facilities. For example, U.S. Pat. No. 5,309,583 to White, et al. discloses a powered lift toilet seat which can be used to assist a person in being raised and lowered relative to a toilet bowl. However, raising and lowering a person relative to a toilet bowl addresses only one problem that many users of such a device possess. Often, these people are also unable to properly clean the genital areas after using a toilet. Toilets including a spray device operable for providing a cleansing wash to the genital area after toilet use are stationary in nature, and therefore are susceptible to soiling by the person using the toilet due to their location within the toilet bowl. Thus, these devices often spray a person with water containing waste prior to performing any cleansing duties. Accordingly, if these devices are not used for a long enough period of time, waste may remain on the user despite use of the spraying device. Another commonly encountered problem is that of the water remaining on a person after using such a spray device. This water can then be absorbed by clothing surrounding the area, thereby providing a potentially embarrassing situation. This remaining water also provides a moist environment conducive to bacterial and fungal growth. This problem has been dealt with by employing a blower which serves to dry the areas of the body which have been washed by the spray nozzle. However, no prior art device has incorporated a lifting apparatus along with a washing and drying device.

Accordingly, what is needed in the art is toilet seat which can be raised and lowered to accommodate individuals who have trouble sitting or standing. What is further needed is such a device wherein a person may be washed and dried after using the toilet. What is still further needed is such a device wherein the apparatuses which perform the washing and drying functions are located such that they are not soilable by the human waste of the person using the toilet. Finally what is needed is such a device wherein the washing mechanism is shiftable between a stored position which is away from waste being expelled and can thereafter be moved to a functional position wherein the washing mechanism is positioned to provide an optimal wash. Such devices will also be enhanced by the shiftability of the nozzle providing the wash whereby the nozzle can be moved laterally to provide a more thorough wash laterally and can be moved in a forward and backward motion to provide a more thorough wash anteriorly and posteriorly.

SUMMARY OF THE INVENTION

The present invention overcomes the problems inherent in the prior art and provides a distinct advance in the state of the art. The lift of the present invention therefore provides an apparatus which performs raising and lowering functions, cleansing functions, and drying functions. Advantageously, the raising and lowering functions is accomplished such that the seat is gently raised and tilted forward and the washing functions provided by the present invention provide a more thorough wash to body parts than was heretofore afforded by the prior art.

The invention preferably comprises a tubular frame which includes a U-shaped bracket forming each side of the lift and an interconnecting brace spanning between the two U-shaped brackets. The tubular frame is preferably metal but can be constructed using wood or polymeric materials. The two U-shaped brackets provide a total of four legs, one at each corner of the lift and each leg preferably includes an adjustable foot extending therefrom. The feet are capable of height adjustment and leveling in a conventional manner such as is used on ordinary household appliances (e.g., washing machines). The frame is adapted to overlie a conventional toilet basin and preferably includes a box-like housing surrounding the frame. In one embodiment of the present invention, the hosing includes three stationary sides and a seat platform which raises and lowers with the seat. In another embodiment, the lifting assemblies raise the entire housing when the lift is activated. This housing is adapted to permit decoration by painting or the like and is formed of a resin-like material or wood.

Connected to the frame is an electric motor coupled with an actuator having a push rod which is extendible therefrom. The motor is electrically connected to a control box located on the frame itself, or the housing when one is provided. Preferably the control box is located on the seat platform in an ergonomically correct position. The control box includes at least one lift switch which serves to activate the motor. In one preferred embodiment, the lift is provided with two switches which serve to operate the lifting assemblies and must both be activated for the lift to operate. To help prevent shock, a transformer is used to change the 120V current to 24V direct current.

The push rod is connected to a yoke at the extending end. This yoke is further attached to a pair of depending plates or drive bars at their proximal ends. This attachment is through a pin which permits rotational movement between the yoke and the drive bars. Preferably, this rotational movement is permitted through the use of bushings which are preferably brass in construction. Secured, preferably by welding, to the distal end of the drive bar pair is crossbar having a pair of opposed ends with the drive bar pair located proximal to the first end thereof. This crossbar is provided with rotational movement when the actuator is activated and the push rod is extended or retracted due to its secure attachment to the drive bar pair. The crossbar further attaches to a plate at each end where it is free to rotate within a complementarily configured bore. Each plate is attached to a corresponding front leg of the frame and further includes a support tube connected thereto through a pair of pins. Each end of the crossbar is also attached to a support brace for a lift assembly.

The lift is provided with a pair of lift assemblies, with each U-shaped frame member being attached to one lift assembly. The lift assemblies include a trio of support braces or arms and a pair of vertically oriented support braces or arms which operate in unison to raise and lower the lift. The trio of support braces includes a lower, middle, and upper arm and the pair of vertically oriented support braces includes a seat brace and a lift brace. The lower support brace is attached at its anterior end to the crossbar and to the plate. The posterior end of the lower support brace is attached to the bottom end of the lift brace. All attachments permit rotational movement therebetween, preferably through the use of brass bushings or the like. The middle support brace is attached at its anterior end to the support tube and at its posterior end to the lift brace at its lower end. The upper support brace is also attached to the support tube at its anterior end and to approximately the midpoint of the seat brace at its posterior end. Again, all attachments permit rotational movement therebetween. Operation of the lift assemblies permits raising and lowering of the lift through cooperative movement of the respective braces and bars which are activated when the crossbar is rotated by the extension of the push rod and rotation of the drive bars. This arrangement permits the lift to gently raise and tilt forward, thereby providing an improvement over the prior art which merely tilts forward.

The distal end of the drive bar pair further straddles a supporting brace having an anterior end and a posterior end. The anterior end of the supporting brace and the drive bar pair are not attached per se but are provided with a spacing therebetween which permits rotational movement. The posterior end of the supporting brace is attached to the motor and provides the motor with support.

The seat braces of the lift assemblies are attached to seat shelves which are adapted to overlie the frame and to support the seat. The seat braces include an anterior portion which overlies the U-shaped frame member, a middle portion upon which the seat sits, and a posterior portion which is supported by the rear brace. The seat is preferably round in configuration and has an open portion in the middle thereof. Attached to the inner portion of the seat and depending therefrom is a shield, preferably made of ⅛th inch plastic. This shield is adapted to fit inside the circumference of a toilet basin when the lift is in a lowered position. The shield is also provided with a passageway through which a washing assembly can be extended. This passageway is preferably in the form of a longitudinal slot which is pre-cut into the shield.

Attachment of the shield to the seat can be done in any conventional fashion including gluing, molding, melting, and fastening.

The lift of the present invention is also provided with a washing assembly which can be projected into the confines of the shield and used to cleanse the lower extremities after use of the toilet facilities. The washing assembly comprises a flexible tube connected at one end to a plumbed water source and at an opposed end to a pipe elbow. The pipe elbow connects the flexible tube to a water pipe which is further connected to a second pipe elbow which is thereafter connected to a spray nozzle. Water flow is controlled by a conventional faucet handle which restricts the flow of water from the plumbed water source through the washing assembly. In order to provide a defined pathway for the flexible tube, a rigid conduit is provided which directs the flexible tube through the longitudinal slot of the shield. Advantageously, this combination of a flexible tube connected to a water pipe connected to a nozzle permits the water assembly to be removed from the confines of the shield when the toilet is in use, thereby avoiding soiling by the waste entering the toilet basin. When a user is done using the toilet, the faucet handle is gripped to move the washing assembly through the longitudinal slot of the shield and into the toilet basin area. When this is done, the flexible tube freely slides within the conduit, thereby moving the water pipe and attendant nozzle into a functional position. The washing assembly can then be activated by rotating the faucet handle and allowing water to pass from the plumbed water source through the flexible tube and water pipe and out the nozzle, thereby providing a cleansing wash to the body parts located above the open portion of the seat. Preferably, the washing assembly is connected to a water source which has the temperature controlled in order to prevent water which is too cold or too hot from contacting the skin of a user. In addition to permitting lateral movement of the washing assembly before, during, and after washing, the slidability of the flexible tube through the rigid conduit permits rotation of the flexible tube back and forth from the front of the lift toward the back of the lift, thereby providing water flow and cleansing in all four directions. This provides a more thorough wash than was heretofore possible using the prior art. Once washing is completed, the washing assembly can be moved away from the toilet by sliding the flexible tube away from the toilet basin and exiting through the longitudinal slot in the shield. This permits storage of the washing assembly in a stored position, away from waste entering the toilet.

A switch on the control box, located atop the seat platform, can then activated to operate an air blower. The air blower is attached to one of the frame members and includes a motor and a blower. By activating the blower, air is directed into the basin area of the toilet where it helps to dry the previously washed body parts. Once drying is completed, the control box switch is deactivated, thereby halting blower operation.

The lift can then be activated using a switch located on the control box which activates the motor, thereby extending the push rod of the actuator and shifting the lifting assemblies from a lowered position to a raised position. Once the lift has raised the seat to an acceptable level, the switch is deactivated and the person using the lift can disembark from the seat in a standing position.

By providing a lift with a shiftable washing assembly, the prior art problems of soiling the washing assembly during toilet use are avoided due to the storage of the washing assembly behind the shield and out of the basin area of the toilet. Additionally, a more thorough wash is provided due to the forward, backward, and lateral movement afforded by the present invention. Prior art problems of residual moisture on washed body parts is also avoided by the drying action of the blower. Finally, the lift can be activated to assist a person to sit down before using the toilet and to assist a person in standing after using the toilet.

DETAILED DESCRIPTION OF THE PREFERRED EMBODIMENT

The following description sets forth preferred embodiments of the present invention. It is to be understood, however, that this description is provided for illustration only and nothing therein should be taken as a limitation upon the overall scope of the invention.

Figure 1:
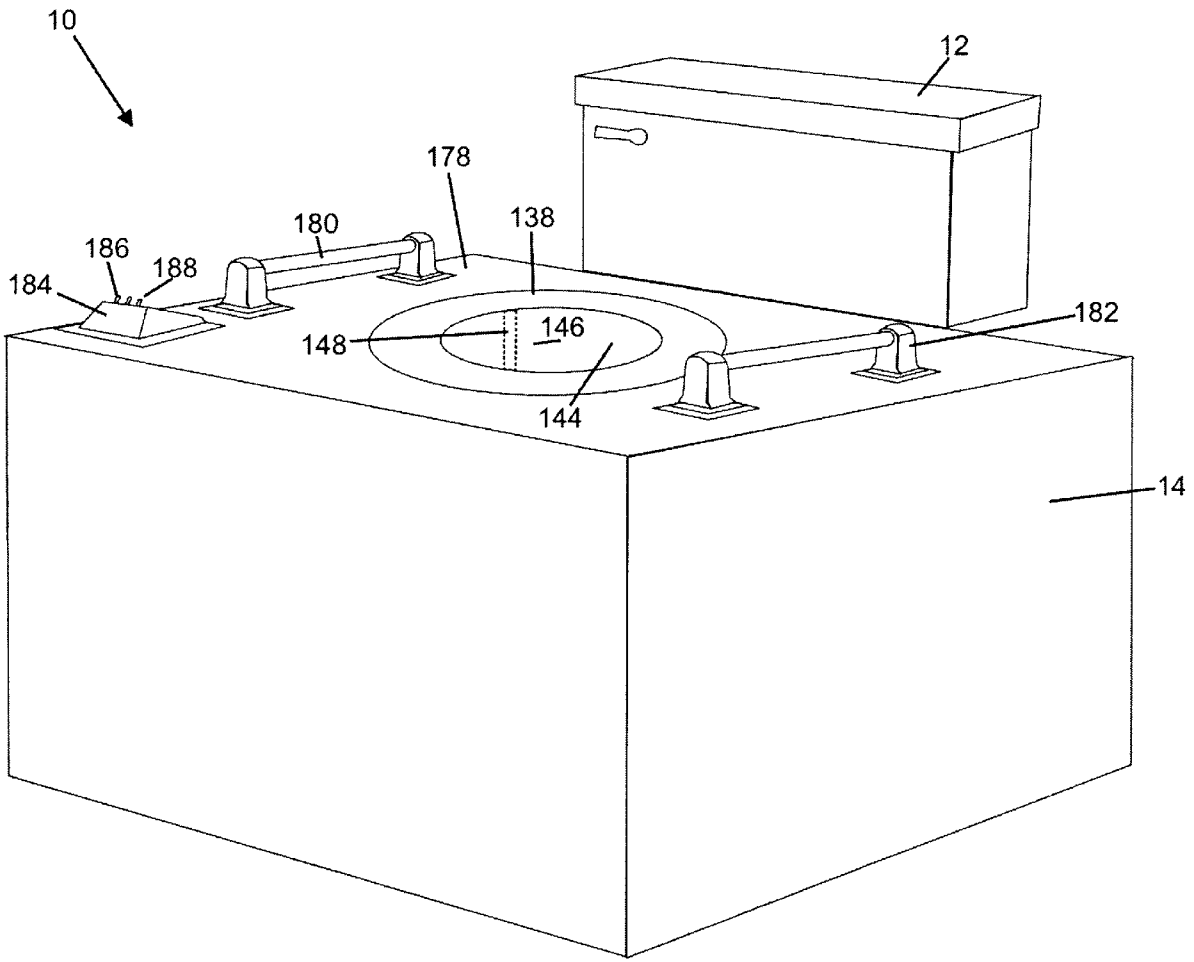
FIG. 1 is a perspective view of a preferred embodiment of the present invention.

The present invention is depicted in FIG. 1 which illustrates a lift 10 in accordance with the present invention. Lift 10 is designed to be placed over a toilet 12, shown best in phantom in FIG. 2. Lift 10 further comprises lift housing 14 adapted to overlie lift frame 16 which includes a U-shaped side frame member 18 on the left side of the frame 16 and a matching U-shaped side frame member 20 on the opposed right side of frame 16. As shown in FIGS. 2–5, each side frame member 18, 20 includes a pair of legs with side frame 18 including left front leg 22 and left back leg 24 and side frame including right front leg 26 and right back leg 28. Legs 22 and 24 are connected via a spanning member 23 while legs 26 and 28 are connected via spanning member 25. Side frame members 18, 20 are connected by rear brace 30 which spans between legs 24 and 28. Each leg, 22, 24, 26, 28 has an adjustable foot 32 extending therefrom which permits leveling in a conventional manner.

Depending from rear brace 30 is electrical motor 34 (illustrated in FIGS. 3–5) operable for activating actuator 36 and extending push rod 38 therefrom. Push rod 38 is rigidly fixed to yoke 40 which in turn is pivotally attached to the proximal ends 48 of a pair of depending drive bars 42, 44 by pin 46 which extends through each respective drive bar 42, 44 and yoke 40. Distal ends 49 of drive bars 42, 44 are rigidly attached to cross bar 50, preferably by welding. Drive bars 42, 44 further straddle side brace 52 at its anterior end 54. Side brace 52 is anchored at its posterior end 56 by motor 34.

Cross bar 50 presents a first end 58 which extends through drive bars 42, 44, side brace 52, and bottom support brace 60 and rotatably attaches to plate 62 welded to leg 22. Plate 62 presents attached support tube 64 which is anchored in place on plate 62 by pins 66, 68. Cross bar 50 further presents a second opposed end 70 extending through bottom support brace 72 and is fixedly attached to plate 74 attached to leg 26. Plate 72 is a mirror image of plate 62 and therefore presents support tube 76 attached by pins 78, 80.

Bottom support braces 60, 72 are part of the lift assemblies 82, 84 which are located on both sides of lift 10 and are responsible for the raising and lowering of a user of the present invention. Lift assemblies 82, 84 are mirror images of one another and therefore have corresponding parts. Thus, lift assemblies 82,84 include bottom support braces 60, 72, middle arms 86, 88 which are rotatably connected to support tubes 64, 76 respectively at their anterior ends 87, 89 by pins 68, 80. The posterior ends 93, 95 of arms 86, 88 are rotatably connected to the lower ends of seat braces 94, 96 by pins 90, 92. Lift assemblies 82, 84 further include upper arms 102, 104 which are also rotatably attached at their anterior ends to support tubes 64, 76 by pins 66, 78, respectively. The posterior ends of arms 102, 104 are rotatably attached to the middle portion of seat braces 94, 96 through pins 110, 112. Lift braces 114, 116 depend from approximately the midpoint of upper arms 102, 104 to the posterior ends of support braces 60, 72. Attachment of lift braces 114, 116 to upper arms 102, 104 is by way of pins 118, 120 which permit rotation therebetween. Similarly, attachment of lift braces 114, 116 to support braces 60, 72 is also done by way of pins 122, 124 which also permit rotation therebetween.

Figure 3:
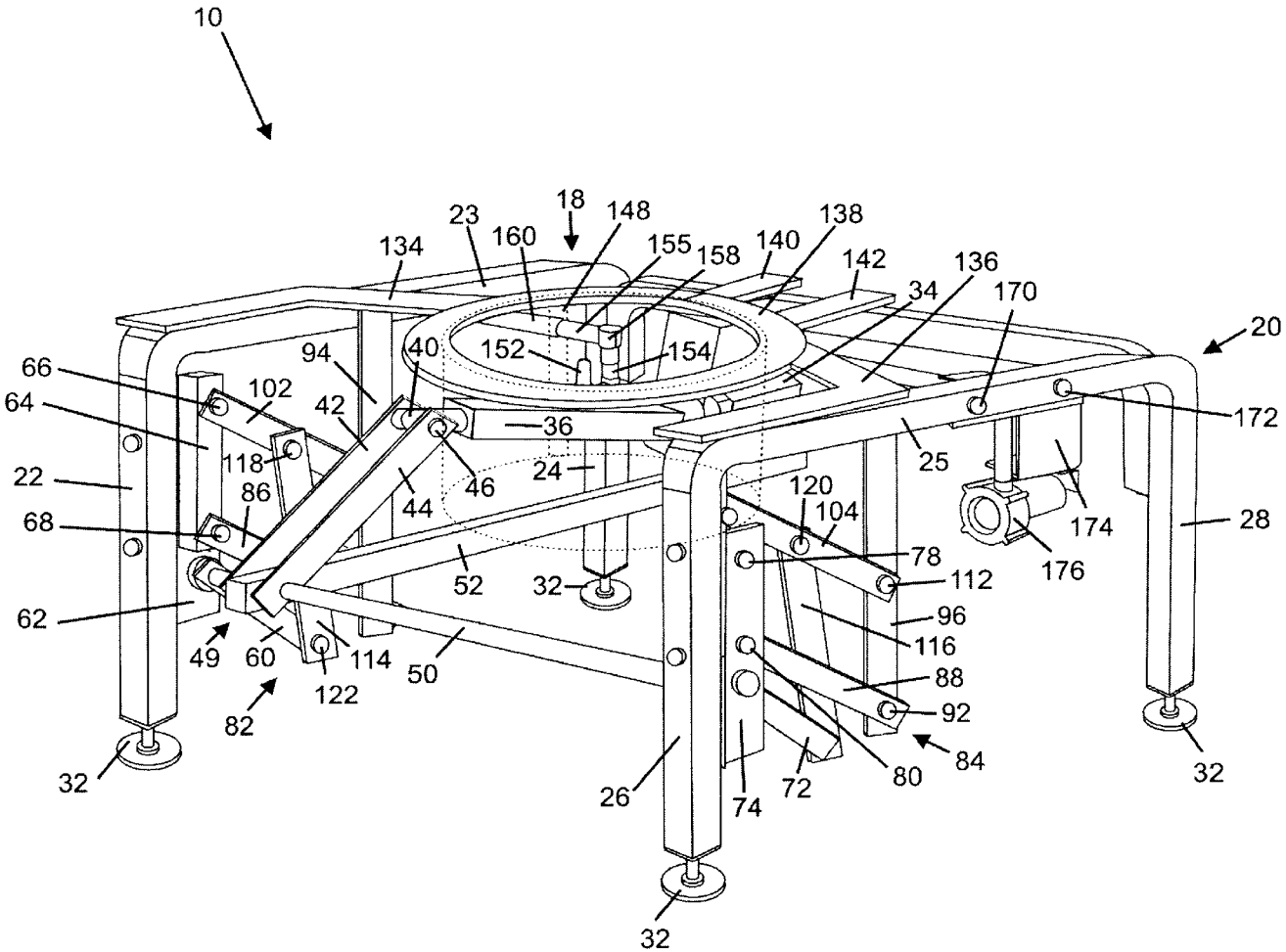
FIG. 3 is a sectional view of a preferred embodiment of the present invention illustrating a shield (shown in phantom)
Figure 4:
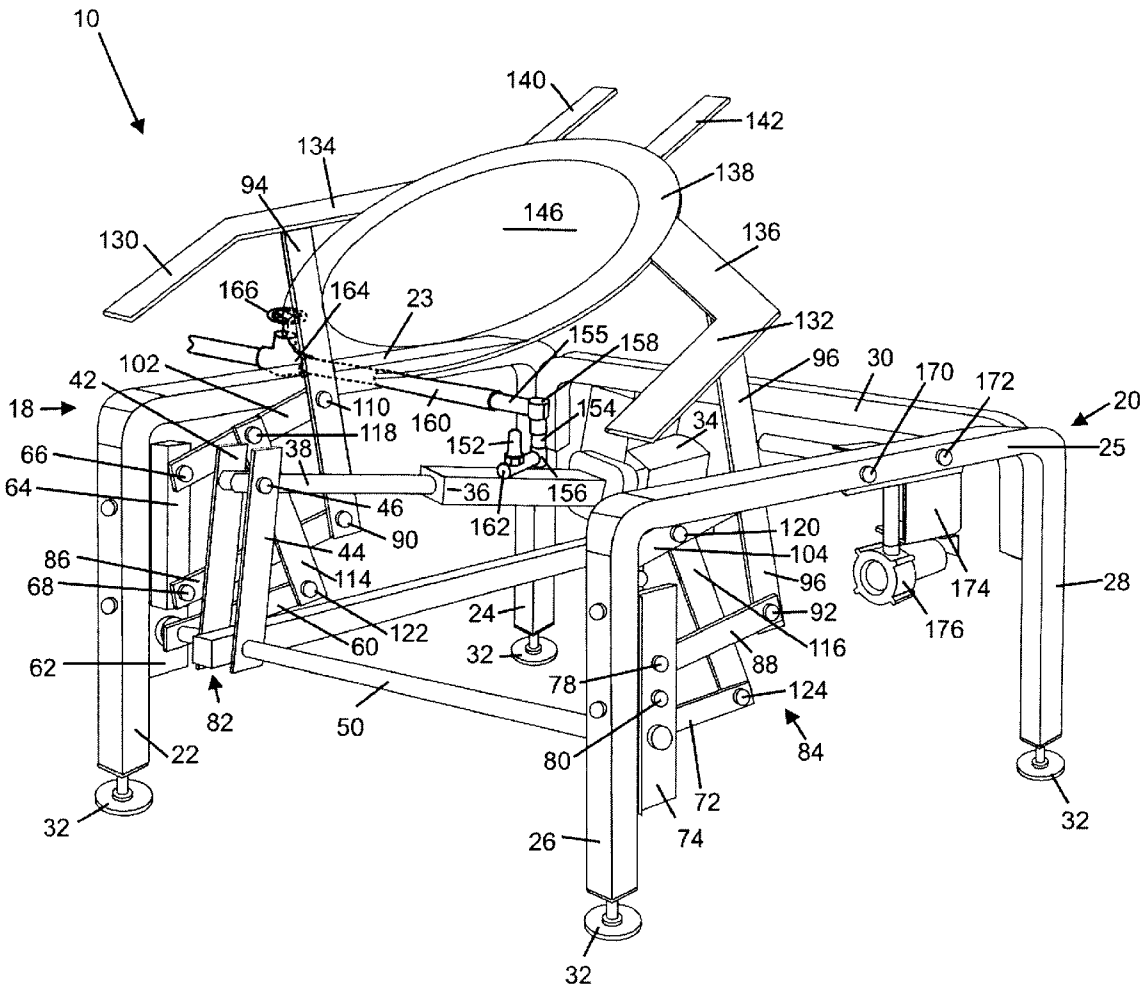
FIG. 4 is a perspective sectional view of a preferred embodiment of the present invention illustrating the lift in a partially raised position.
Figure 5:
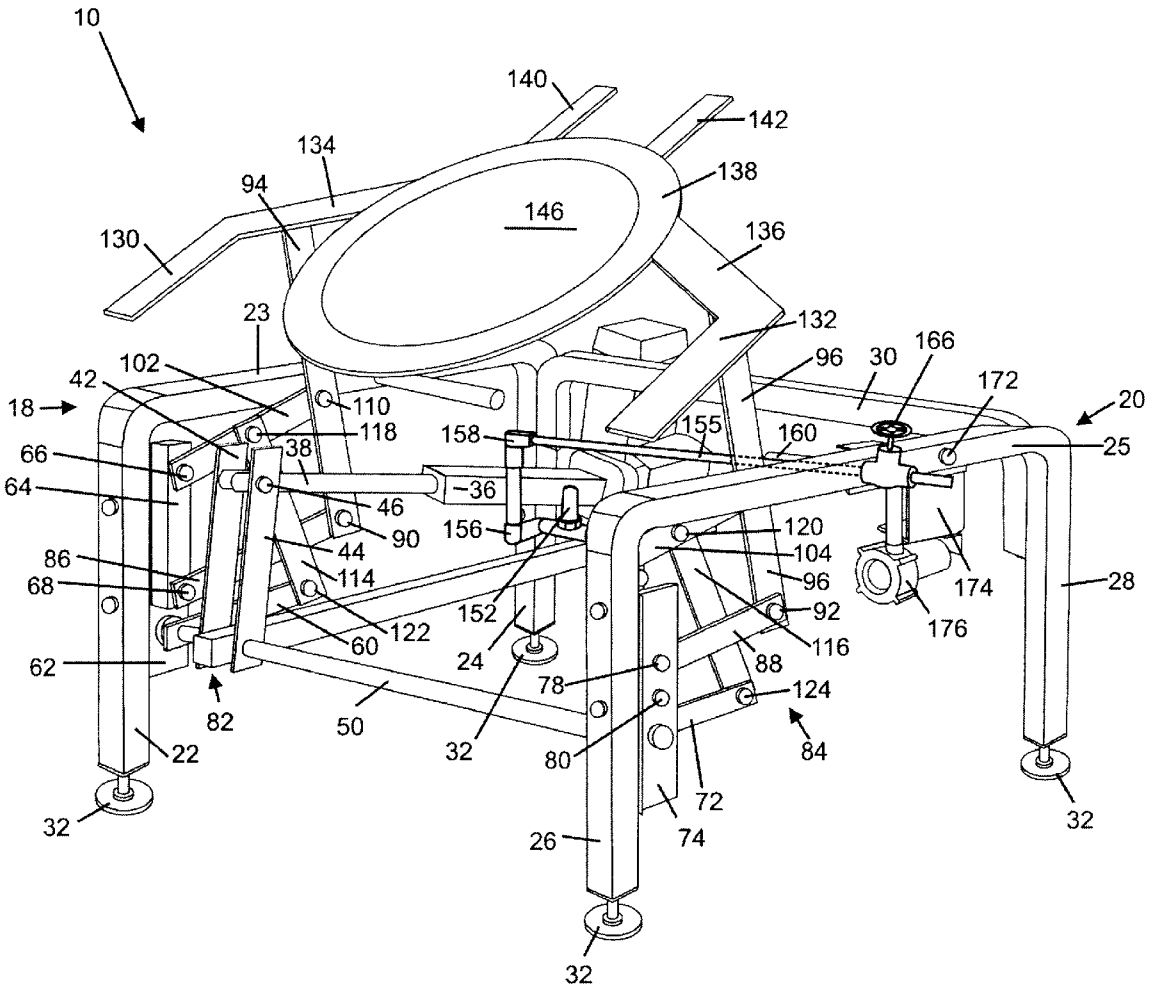
FIG. 5 is a perspective sectional view of a preferred embodiment of the present invention illustrating an alternative placement of the washer assembly.

Seat shelves 126, 128 present anterior portions 130, 132 adapted to overlie U-shaped side frames 18, 20, midportions 134, 136 which are adapted to contact seat 138 and provide support therefore, and posterior portions 140, 142 which are adapted to overlie rear brace 30. As illustrated in FIG. 3, seat 138 preferably includes a downwardly depending shield 144 which is attached near the open portion 146 of seat 138. Shield 144 includes longitudinal slot 148 which is adapted to receive washer assembly 150 therethrough. Washer assembly 150 includes nozzle 152 attached to pipe 154 having lower elbow 156 and upper elbow 158. Flexible pipe 155 is connected to upper elbow 158 and extends through stationary conduit 160. Flexible pipe 155 is movable through conduit 160 by sliding pipe 155 laterally toward and away seat 138. Conduit 160 extends through U-shaped side frame 18. Pipe 154 further presents a first end 162 which is attached to nozzle 152 and a second end 164 which is attached to upper elbow 158. Faucet handle 166 is located between pipe 155 and a plumbed water source at one end and at upper elbow 158 at its opposed end. Faucet handle 166 is operable for controlling the flow of water from the water source through pipe 155, around elbows 158, 156, through pipe 154 and out nozzle 152. Faucet handle 166 is also operable for providing the lateral movement of pipe 154 by having flexible pipe 155 connected to the plumbed water source thereby permitting lateral movement. Additionally, the flexible pipe 155 permits a degree of rotational movement which gently rocks nozzle 152 anteriorly and posteriorly and thereby providing a movable water stream upon a user's lower body parts. Conduit 160 further provides a rigid passageway which permits lateral movement of flexible pipe 155 along a defined pathway.

Lift 10 further includes a dryer assembly 168 attached to the lift frame 16 by pins 170, 172. Dryer assembly 168 includes dryer motor 174 and dryer blower 176. Blower 176 directs an air current toward the basin of the toilet 12, thereby hastening water evaporation from a user's skin.

Figure 2:
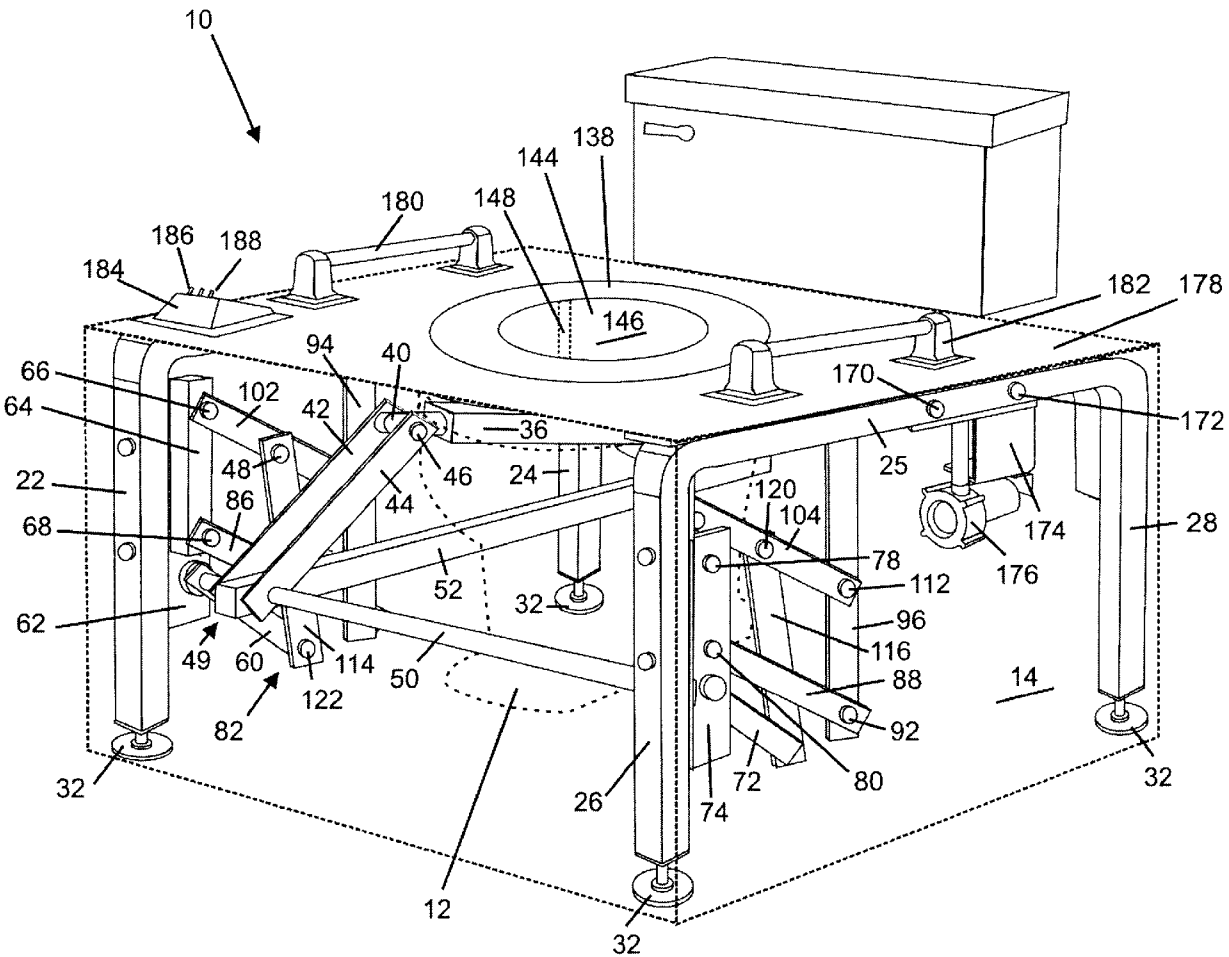
FIG. 2 is a sectional view of a preferred embodiment of the present invention illustrating placement of the invention around a toilet (shown in phantom)

As shown by FIG. 2, lift housing 14 includes seat platform 178 which is attached to seat 138 so that it moves in unison with seat 138 when push rod 38 operates lift assemblies 82, 84. Grab bars 180, 182 are provided in order to lend extra support to users of the present invention. Finally, seat platform 178 includes control box 184 which is electrically connected to motor 34 and is operable for activating and deactivating actuator 36. Control box 184 contains switch 186 operable for activating motor 34 and switch 188 operable for activating dryer motor 174.

Figure 6:
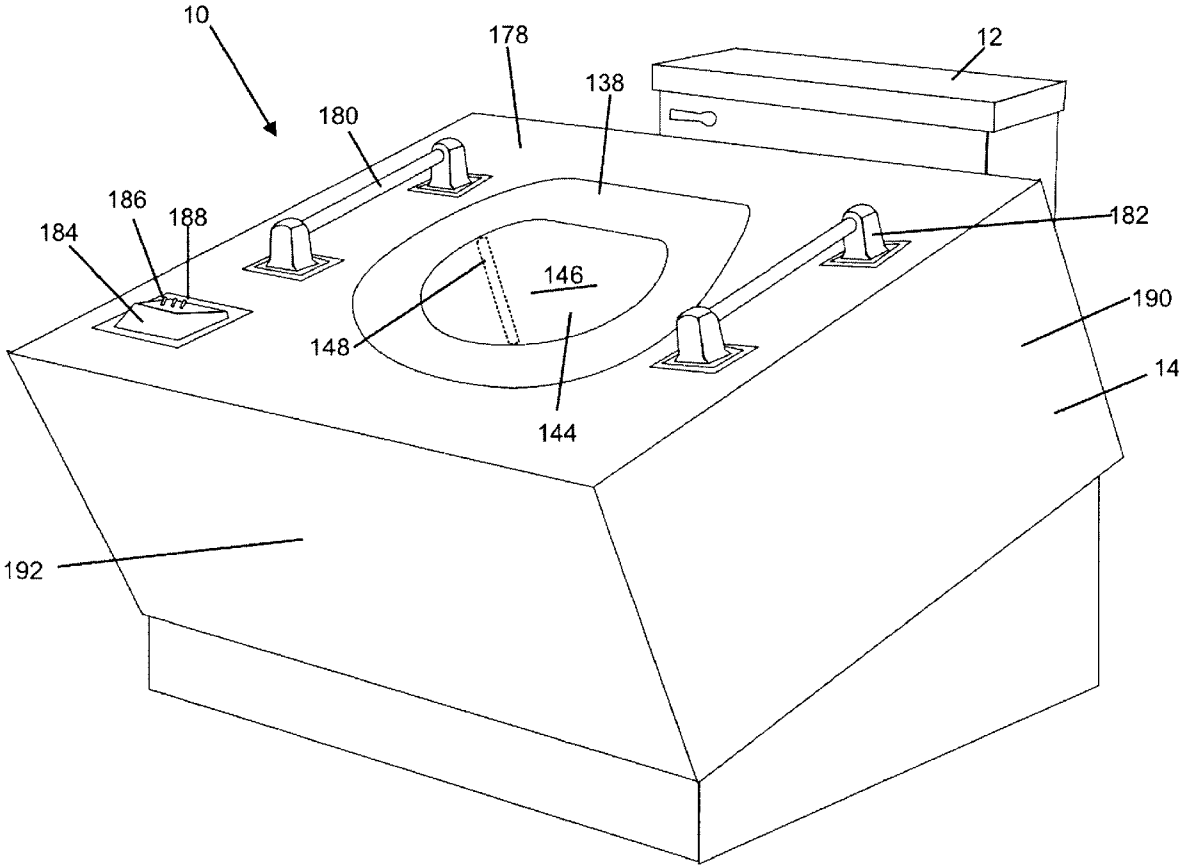
FIG. 6 is a perspective view of a preferred embodiment of the present invention illustrating the lift in a partially raised position.

An alternative embodiment of the lift 10 is shown in FIG. 6. In this embodiment, the lift housing 14 raises and lowers as a unit as the lift assemblies 82, 84 are raised and lowered. The housing therefore includes seat platform 178 and three sides. Side 190 is perpendicular to seat platform 178 and has an opposing side (not shown) on the other side of seat platform 178. Side 192 is oriented at right angles to the other sides 178, 190.

To use the present invention, lift 10 is activated using switch 186 on control box 184 to bring seat platform 178 to a raised position. This raised seat position is illustrated best in FIGS. 4 and 5. This permits a user to place their weight upon seat platform 178 prior to activating motor 34 through control box 184, thereby retracting push rod 38 and lowering lift assemblies 82, 84 and seat platform 178. Once push rod 38 is retracted and lift assemblies 82, 84 are lowered, open portion 146 of seat 138 is positioned directly above the basin of toilet 12, thereby permitting use of the toilet 12. This lowered position is shown best in FIGS. 2 and 3. Once a person is done using toilet 12, faucet handle 166 is moved laterally toward toilet 12 in order to move nozzle through longitudinal slot 148 in shield 144 and position nozzle 152 below a user's lower extremities. Faucet handle 166 is then rotated in a conventional manner to provide water through pipe 155, around upper elbow 158 and lower elbow 156, through pipe 154, and out nozzle 152, thereby providing a cleansing wash to the lower extremities positioned above open portion 146. Advantageously, while water is being expelled through nozzle 152, a user may move washer assembly 150 laterally by gripping faucet handle 166 and moving it in a back and forth motion toward and away toilet 12, thereby providing a more thorough wash over a greater surface area. Additionally, nozzle 152 can be rotated to provide a water stream which is perpendicular to the lateral motion provided by lateral movement of washer assembly 150. This is done by gripping faucet handle 166 and moving it in anterior and posterior directions. Once washing is completed, faucet handle 166 can be rotated to stop water flow through pipe 154 and out nozzle 152 and washer assembly 150 can be moved laterally through longitudinal slot 148 in shield 144 and away from toilet 12. In this manner, washer assembly is located in a stored position outside of the basin of toilet 12. Thereafter, a switch 188 on control box 184 is activated to start dryer motor 174 which directs an air flow into the basin of toilet 12, thereby drying the previously washed body parts. Once drying has proceeded to a satisfactory stage, switch 188 is deactivated, thereby turning off dryer motor 174. Switch 186 can then be activated to raise seat platform 178, thereby assisting a user to a standing position.

Lifting action of the lift assemblies 82, 84 is provided by motor 34 activated by switch 186 on control box 184. When push rod 38 is in a retracted position, seat platform 178 is in a lowered position such that open portion 146 of seat 138 is directly above the basin of toilet 12 and seat shelf anterior portions 130, 132 are overlying U-shaped side frame members 18, 20, seat shelf mid-portions 134, 136 are supporting seat 138, and seat shelf posterior portions 140, 142 are overlying rear brace 30. This positioning of the seat shelves in the lowered position is illustrated best in FIG. 3. By activating switch 186 on control box 184, push rod 38 extends thereby rotating drive bars 42, 44 and cross bar 50. When cross bar 50 rotates, bottom support braces 60, 72 also rotate. This rotational motion of bottom support braces 60, 72 moves lift braces 114, 116 in an upward manner thereby moving connected upper arms 102, 104 in an upward manner. This cooperative movement also results in seat braces 94, 96 rotating middle arms 86, 88 in an upward fashion, and thereby forcing seat shelves 126, 128 to raise seat 138.

I claim:

1. A lifting and cleansing apparatus comprising:

a frame adapted to overlie a toilet, said frame presenting a front side and an opposed back side;

a lifting assembly attached to said frame;

a seat attached to said lifting assembly; and a cleansing assembly attached to said frame, said cleansing assembly comprising a water pipe connected to a water source and a nozzle connected to said pipe, said pipe being slidable laterally between a functional position and a stored position wherein said nozzle is positioned under said seat when in said stored position and said pipe being operable to rotate between said frame front side and said frame back side.

2. The apparatus of claim 1 further comprising an air blower attached to said frame.

3. The apparatus of claim 2, further comprising a control box operable for activating said air blower.

4. The apparatus of claim 2, said air blower being capable of expelling warmed air.

5. The apparatus of claim 1, said lifting assembly including seat supports.

6. The apparatus of claim 1, said lifting assembly including an actuator.

7. The apparatus of claim 6, said lifting assembly further including lifting braces.

8. The apparatus of claim 1, further comprising a housing overlying said frame.

9. The apparatus of claim 8, said seat platform being shiftable between an up position and a down position.

10. The apparatus of claim 8, said housing including a seat platform.

11. The apparatus of claim 10, said seat platform including a grab bar.

12. The apparatus of claim 10, said seat platform including a control box.

13. The apparatus of claim 12, said control box operable for controlling the raising and lowering of said seat.

14. The apparatus of claim 1 further comprising a shield depending from said seat.

15. The apparatus of claim 14, said shield presenting an entryway, said entryway permitting the passage of said nozzle therethrough.

16. The apparatus of claim 1, said cleansing assembly further including a conduit complementally sized to slidingly receive said water pipe therethrough.

17. The apparatus of claim 16, said conduit attached to said frame.

18. A lifting and cleansing apparatus comprising:

a frame presenting a front side and an opposed back side, said frame adapted to overlie a toilet;

a lifting assembly attached to said frame;

a seat attached to said lifting assembly; and a cleansing assembly attached to said frame, said cleansing assembly comprising a water pipe connected to a water source and a nozzle connected to said pipe, said nozzle adapted to direct a flow of water therefrom and said pipe being both laterally shiftable and rotatable thereby permitting said nozzle to direct water flow in all four directions.

* * * * *